United States Patent [19]

Puma

[11] 3,987,965

[45] Oct. 26, 1976

[54] WATER VALVE

[76] Inventor: Anthony R. Puma, Curlew & Fisher Roads, Palm Harbor, Fla. 33563

[22] Filed: Apr. 30, 1975

[21] Appl. No.: 573,368

[52] U.S. Cl. ..... 239/583; 239/590.3

[51] Int. Cl.[2] ..... B05B 1/30

[58] Field of Search ..... 222/509, 501, 518, 402.15, 222/402.25, 402.14; 251/231, 339, 293; 239/407, 428.5, 456, 541, 577, 582, 583, 449

[56] References Cited

UNITED STATES PATENTS

| | | | |
|---|---|---|---|
| 576,068 | 1/1897 | O'Lally | 251/339 X |
| 1,267,123 | 5/1918 | Schott | 239/449 X |
| 1,324,206 | 12/1919 | Nickell | 222/509 X |
| 1,380,973 | 6/1921 | Kelsea | 222/509 |
| 2,785,881 | 3/1957 | Dolan | 239/428.5 X |
| 2,978,188 | 4/1961 | Fredrikson | 239/583 X |
| 3,252,626 | 5/1966 | Belka | 222/402.14 X |

*Primary Examiner*—John J. Love
*Attorney, Agent, or Firm*—Stewart and Kolasch, Ltd.

[57] ABSTRACT

An on-off water valve which is adapted to be removably fixed to the end of a water faucet which comprises a valve housing, a valve seat extending across the valve housing and dividing said housing into an upper and lower portion, said valve seat provided with a centrally disposed aperture therein, a valve stem extending axially through the valve housing and provided with a valve head which is slidably received by said aperture in a water-tight manner, and a control arm disposed from the outside of the valve housing and extending through said housing and communicating with the base of the valve stem, said control arm being adapted to be moved axially with respect to the valve housing, the valve head being seated or unseated in the valve seat depending upon the direction of movement of said control arm.

12 Claims, 6 Drawing Figures

WATER VALVE

BACKGROUND AND SUMMARY OF THE INVENTION

The present invention is directed to an on-off valve which is adapted to be attached to a conventional water faucet. More particularly, the present invention concerns an on-off water valve which eliminates the necessity of regulating the water tap to an acceptable water temperature every time the water faucet is utilized.

In the conventional water faucets which are utilized in connection with sinks, bathtubs and shower facilities, it is always necessary to adjust the valves controlling both the hot and the cold water in order to obtain a water flow which has an acceptable water temperature. Of course, in the process of regulating the water temperature, a substantial amount of water is lost in the process, including heated water which requires a certain amount of energy to bring it to the heated state. Thus, there is not only a loss of the water per se, but also a loss in the energy required to produce the heated water. Furthermore, there is the inherent inconvenience of being required to regulate the water tap in order to obtain a desirable water temperature.

Accordingly, it is an object of the present invention to provide an improved off-on water valve which can be readily adapted to conventional faucets and which is effective in producing a desired water temperature much more readily than the prior art valve devices without the necessity of regulating the existing hot and cold taps of the water faucet.

Another object of the present invention is to provide an improved on-off water valve which not only is effective in achieving a desired water temperature in a relatively short period of time, but also provides a savings in the quantity of water which is normally wasted when utilizing conventional water valves with a concurrent savings in the amount of energy required to heat the water which has been lost during the regulation of the water temperature.

A further object of the present invention is to provide an improved on-off water valve which can be manually operated and which requires no springs or other complicated elements to achieve its effective operation.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The on-off water valve of the present invention is a simple hand-operated on-off valve which is readily adaptable to fit the average water faucet. The valve of the present invention enables an individual to preset the temperature and pressure of the water with the existing valves and then to control the flow of the water by the mechanical operation of the on-off valve of the present invention. Thus, by presetting the temperature and pressure of the water with the existing valve, the flow of the water can be either turned off or turned on by either lowering or raising a lever arm which is associated with a valve stem and valve head disposed on the inside of the water valve. The valve housing of the present invention contains a valve stem with a valve head associated therewith, a ring washer disposed around the valve head, a valve seat which is adapted to receive the valve head, an aerator device and a lever arm which is connected to the valve stem. All of the internal components of the hand-operated on-off water valve of the present invention are removable from the valve housing by merely unscrewing the lever arm handle and dismantling the valve. The on-off water valve of the present invention is provided with an off position, an on position and a hold-on position which permits the flow of the water to proceed without requiring the operator to hold the valve open in its on position.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DESCRIPTION OF THE PREFERRED EMBODIMENTS

Figure 1:
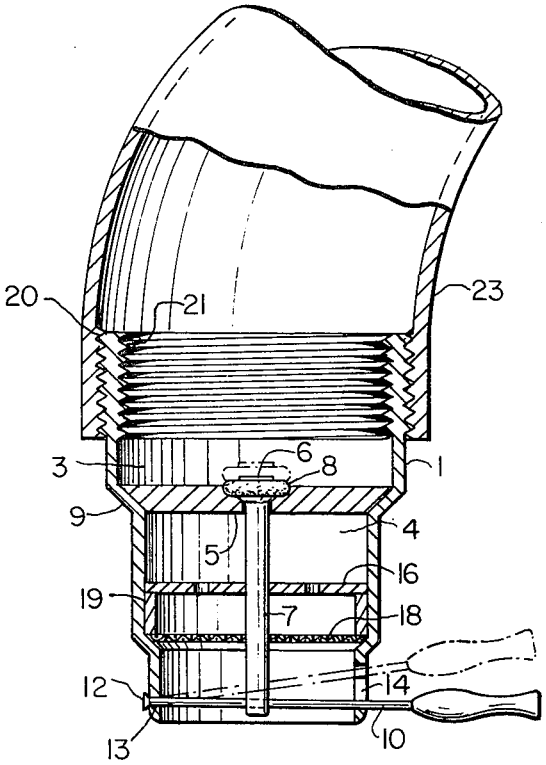
FIG. 1 is a cross-sectional view of the hand-operated on-off water valve of the present invention shown as it is attached to a conventional water faucet.
Figure 6:
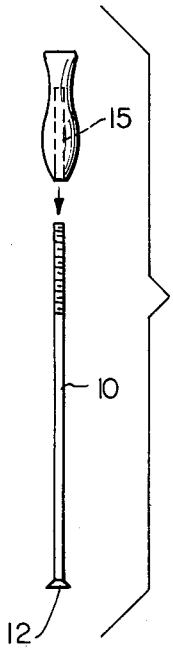
FIG. 6 shows the lever arm in greater detail.
Figure 5:
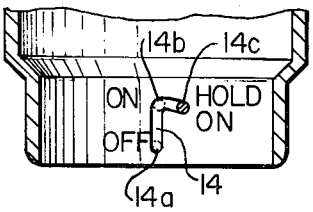
FIG. 5 shows the various positions of the lever arm for controlling the flow of water through the water valve.
Figure 4:
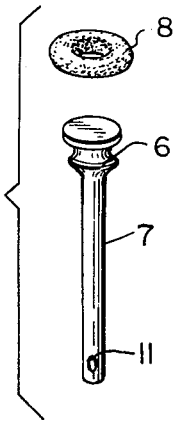
FIG. 4 shows the valve stem, valve head, the ring washer for attachment to the valve head, the valve seat and a slot in the valve stem for accommodating the lever arm.

Referring now to the drawings, where the same reference numerals are used in the various views to indicate identical elements, the on-off water valve of the present invention, particularly with respect to FIG. 1, comprises a valve housing 1 divided internally by a replaceable valve seat 2 which divides the valve housing into an upper portion 3 and a lower portion 4. The valve seat 2 is provided with an aperture 5 which is adapted to receive the valve head 6 of a valve stem 7. Advantageously, the valve head 6 is provided with a ring washer 8. The valve seat 1 extends across the valve housing and engages said valve housing at the shoulder portion 9. The valve stem 7 extends axially through the valve housing and, as previously noted, is provided with a valve head which is removably received by the aperture provided in the valve seat, in a water-tight manner. A control arm 10 is disposed on the outside of the lower portion of the valve housing and extends through said housing into operative communication with the base of the valve stem. As noted in FIG. 4, the valve stem 7 is provided with a slot 11. Thus, the valve stem which contains an enlarged head portion 12 can be threaded through a slot 13 provided on one side of the lower portion of the valve housing, through slot 11 and also through elongated slot 14 located on the other side of the housing and finally secured with a handle 15. As can be noted from FIG. 1, the lever arm 10 is provided with a threaded end portion to which the handle 15 is screwably attached. The slot 14, as shown in FIG. 5, is in the shape of an inverted L with its base portion being slightly canted. Thus, the slot 14 has an off position 14*a*, an on position 14*b* and a hold-on position 14*c*.

Figure 2:
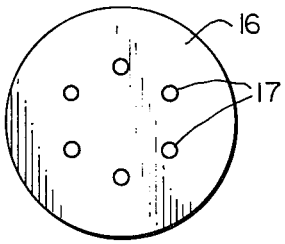
FIG. 2 is a plan view of a plate which is provided with a plurality of apertures and which makes up the upper portion of the aerator device which is disposed in the water valve.
Figure 3:
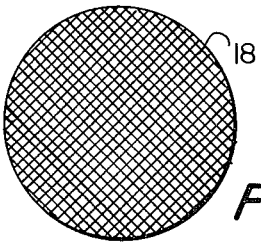
FIG. 3 is a plan view of a screen which is disposed below the apertured plate and cooperates with said plate in forming the aerator device.

An aerator device is disposed in the housing between the lever arm 10 and the valve seat 2. The aerator device comprises a plate 16 provided with a plurality of apertures 17 and a screen portion 18. A plan view of the perforated plate 16 and the screen 18 are shown in FIGS. 2 and 3, respectively. The plate member 16 and the screen 18 are joined together at their periphery by a structural member 19. As can be readily understood by referring to FIG. 1, the valve stem 7 is slidably disposed in the aerator device through a centrally disposed aperture provided therein. Although FIG. 2 shows the apertures in plate 16 arranged in a specific pattern, it should be readily understood that plate 16 can be provided with any desired number of apertures or any size apertures in any desired shape or pattern.

The on-off valve of the present invention is provided at the end portion of the upper housing with external and internal threads 20 and 21 and in the embodiment shown in FIG. 1, the external threads 20 on the housing are adapted to engage with internal threads 22 on the inside surface of the faucet 23.

In operation, the on-off water valve of the present invention is first screwed into the end of a conventional water faucet utilizing either the internal or the external threads provided on the end portion of the upper housing of the on-off valve. Once the on-off valve is in position, the temperature and the pressure of the water is regulated utilizing the existing valve provided for the water faucet. After the temperature and pressure of the water have been established to a desired level, the lever arm is placed in the off position. When the water valve is in the off position, the valve head 6 containing the ring washer 8 is seated in the valve seat by the pressure of the water flow. When it is desired to use the water faucet, the lever arm is raised from an off to an on position or a hold-on position which raises the valve head from the valve seat thereby permitting the water to flow around the valve head, through the aperture provided in the valve seat, through the aerator and out the lower portion of the valve housing. Since the temperature and pressure of the water have already been preselected, by the previous regulation of the valves of the water faucet, there is no further adjustment necessary to obtain a water flow with the desired temperature and pressure except for the operation of the valve stem 10.

The on-off water valve of the present invention is manually operated and contains no springs or other elements which are subject to eventual maintenance problems. It is adapted to be hand operated and fit sinks of the single faucet design wherein the water temperature and pressure can be preset by the existing valve system. The on-off water valve of the present invention avoids the loss of water normally produced by regulating water valves and accordingly, provides substantial savings in both water and the energy to heat said water by controlling the flow of water in a desired manner.

The invention being thus described, it will be obvious that the same may be varied in many ways. Such variations are not to be regarded as a departure from the spirit and scope of the invention, and all such modifications are intended to be included within the scope of the following claims.

I claim:

1. An on-off water valve which is adapted to be removably fixed to the end of a water faucet which comprises a valve housing, a valve seat extending across the valve housing and dividing said housing into an upper and lower portion, said valve seat provided with a centrally disposed aperture therein, a valve stem extending axially through the valve housing and provided with a valve head which is slidably received by said aperture in a water-tight manner, said valve stem containing a slot in its lower portion and the lower portion of the valve housing containing slots on both sides thereof which are in alignment with each other and with the slot in the valve stem, and a control arm extending through all of said slots to the outside of said valve housing, said control arm being adapted to be moved axially with respect to the valve housing, the valve head being seated or unseated in the valve seat depending upon the direction of movement of said contol arm.

2. The on-off water valve of claim 1, wherein the valve head is larger than the aperture in the valve seat, said valve head extending into the upper portion of the valve housing and the valve stem extending into the lower portion of the valve housing.

3. The on-off water valve of claim 1, wherein an aerator device is disposed in the valve housing between the valve seat and the control arm, said valve stem slidably extending through said aerator device.

4. The on-off water valve of claim 3, wherein the aerator device comprises a plate provided with a plurality of apertures and a screen, said plate and screen being spaced apart in substantially parallel relationship with respect to each other and traversing the valve housing.

5. The on-off water valve of claim 4, wherein the aperture plate is disposed between the screen and the valve seat.

6. The on-off water valve of claim 1, wherein the valve head is provided with a ring washer.

7. The on-off water valve of claim 1, wherein a slot is provided in the valve housing and the control arm extends into said housing through said slot, said slot being elongated toward the upper portion of the housing thereby permitting movement of the control arm toward said upper portion of the housing which unseats the valve head from the valve seat to an open position.

8. The on-off water valve of claim 7, wherein the slot is provided with a notch which is offset from the slot to provide a hold-on position for the valve.

9. The on-off water valve of claim 7, wherein the slot has the shape of an inverted L.

10. The on-off water valve of claim 1, wherein one of the slots in the housing is elongated toward the upper portion of the housing thereby permitting movement of the control arm in this direction.

11. The on-off valve of claim 10, wherein the control arm is provided with an enlarged head portion at one end and a threaded portion at the other end, said enlarged head portion being larger than the corresponding slot in the housing and said threaded portion containing a screwably attached handle.

12. The on-off valve of claim 1, wherein the end portion of the upper housing is provided with external and internal threads for screwable attachment to a faucet.

* * * * *